United States Patent [19]

Greve

[11] 3,974,007

[45] *Aug. 10, 1976

[54] METHOD AND APPARATUS FOR THE PRODUCTION OF FILTER ROD SECTIONS OR THE LIKE

[75] Inventor: Heinz Greve, Hamburg, Germany

[73] Assignee: Hauni-Werke Korber & Co., KG, Hamburg, Germany

[ * ] Notice: The portion of the term of this patent subsequent to Feb. 11, 1990, has been disclaimed.

[22] Filed: Dec. 5, 1974

[21] Appl. No.: 530,040

Related U.S. Application Data

[62] Division of Ser. No. 360,598, May 15, 1973, Pat. No. 3,865,016, which is a division of Ser. No. 131,167, April 5, 1971, Pat. No. 3,741,846.

[30] Foreign Application Priority Data

Apr. 11, 1970 Germany ..... 2017360

[52] U.S. Cl. ..... 156/64; 93/1 C; 93/77 FT; 131/261 A; 156/378; 156/433; 156/441

[51] Int. Cl.[2] ..... A24C 5/50

[58] Field of Search ..... 156/64, 160, 161, 166, 156/180, 200, 201, 229, 296, 350, 360, 378, 428, 433, 441, 461, 494, 495; 93/1 C, 77 FT; 28/71.3; 316/6; 131/261 A

[56] References Cited

UNITED STATES PATENTS

| | | | |
|---|---|---|---|
| 2,822,024 | 2/1958 | Himmelheber et al. | 156/360 |
| 3,017,309 | 1/1962 | Crawford et al. | 156/161 |
| 3,320,110 | 5/1967 | Gallagher | 156/441 |
| 3,361,137 | 1/1968 | Watson | 93/1 C |
| 3,405,717 | 10/1968 | Berger et al. | 93/1 C |
| 3,741,864 | 6/1973 | Greve | 156/64 |
| 3,779,849 | 12/1973 | Beard et al. | 93/1 C |
| 3,865,016 | 2/1975 | Greve | 156/64 |

FOREIGN PATENTS OR APPLICATIONS

| | | | |
|---|---|---|---|
| 1,083,111 | 9/1967 | United Kingdom | 156/64 |
| 718,332 | 9/1952 | United Kingdom | 93/77 FT |

*Primary Examiner*—Douglas J. Drummond
*Assistant Examiner*—John E. Kittle
*Attorney, Agent, or Firm*—Peter K. Kontler; John Kurucz

[57] ABSTRACT

Filter rod sections are produced by moving a tow of filamentary filter material past a device which showers the filaments with atomized plasticizer and by thereupon converting the thus treated tow into a rod-like filler which is wrapped to form a filter rod. The latter is severed to yield a succession of filter rod sections which are transported by a fluted drum to storage or to a machine for the production of filter-tipped smokers' products. Groups of filter rod sections are withdrawn from the flutes of the drum at regular intervals for weighing to thus determine the quantity of filter material and/or plasticizer. The results of the weighing operation are utilized to adjust the feeding mechanism for the tow and/or plasticizer if the measured quantities deviate from desired quantities. The feeding mechanism for the tow employs rolls which can be driven at a variable speed to thereby subject the filaments of the tow to a more or less pronounced stretching action. The feeding mechanism for the plasticizer employs a rotary brush which removes plasticizer from the periphery of a drum dipping into a supply of plasticizer, and a variable-speed drive for the drum.

12 Claims, 5 Drawing Figures

METHOD AND APPARATUS FOR THE PRODUCTION OF FILTER ROD SECTIONS OR THE LIKE

CROSS-REFERENCE TO RELATED APPLICATION

This is a division of my copending application Ser. No. 360,598 filed May 15, 1973, now U.S. Pat. No. 3,865,016 granted Feb. 11, 1975. The application Ser. No. 360,598 is a division of application Ser. No. 131,167 filed Apr. 5, 1971, now U.S. Pat. No. 3,741,846 granted June 26, 1973.

BACKGROUND OF THE INVENTION

The present invention relates to a method of producing rod-shaped articles, particularly such rod-shaped articles which constitute or form part of smokers' products including plain or filter-tipped cigarettes, cigarillos and cigars. More particularly, the invention relates to improvements in a method of producing rod-shaped articles of the type wherein one or more main components are contacted by or otherwise treated or assembled with one or more secondary components to form a rod-shaped intermediate product which is thereupon subdivided into articles of desired length. Typical examples of such articles are filter rod sections wherein the main component consists of a tow of filamentary filter material and the secondary or auxiliary component is a plasticizer or bonding medium which is applied to the tow in a liquid state and is thereupon caused or allowed to set in order to impart to the filter rod sections a desirable resistance to deformation as well as to enhance the smoke-filtering characteristics of such sections.

As a rule, the density of a tow of filamentary filter material which constitutes the main component of filter rod sections or filter elements varies within a wide range. Therefore, it is necessary to regulate the density of the tow prior to formation of a filler which is thereupon wrapped to form a rod and severed to yield filter rod sections of desired length. The filaments of the tow are crimped and the number of crimps per unit length of the tow determines the density of the respective portions of the tow. In the absence of any regulating action, the density of filamentary filter material in filter rod sections would vary not only from increment to increment of a particular filter rod section but also from section to section. Consequently, the resistance which the filter rod sections would offer to the passage of smoke would also vary from filter cigarette to filter cigarette or from filter-tipped cigar to filter-tipped cigar. Such differences in the resistance of filter rod sections to the passage of smoke are highly undesirable.

It is already known to provide a filter rod making machine with means for subjecting the tow to a variable stretching action for the purpose of reducing the difference between the densities of successive increments of the tow. East German Pat. No. 61,974 discloses a detector which scans the tow and produces signals which are utilized for regulation of the stretching action. The detector is a pneumatic detector which determines the resistance to the flow of an air stream across successive increments of the tow or a beta ray detector which includes a source of beta rays at one side of the path of the tow and an ionization chamber which is located opposite the source and furnishes signals indicating the rate at which the beta rays penetrate through the tow. A drawback of pneumatic detectors is that they are not always reliable, i.e., a minor leak in a single one of several conduits which convey the air stream or streams is likely to cause the generation of signals which are not truly indicative of the density of measured portions of the tow. Beta ray detectors are quite expensive and they must be provided with complicated safety devices to protect the attendants.

SUMMARY OF THE INVENTION

An object of the invention is to provide a novel and improved method of producing rod-shaped articles, particularly sections of filter rods wherein one or more main components are assembled with or contacted by one or more secondary components, according to which the quantity of one or more components in the articles can be measured or determined in a novel and improved way and the result of measurement used to insure that the quantity of such component or components does not appreciably deviate from a desired quantity.

Another object of the invention is to provide a novel and improved method of producing filter rod sections or filter elements for use in machines for the production of filter cigarettes, cigars or cigarillos.

A further object of the invention is to provide a method of producing filter rod sections or like rod-shaped articles wherein not only the average quantity of one or more components per rod-shaped article but also the quantity from increment to increment of any given article is more uniform than in articles which are produced in accordance with the presently known methods.

An additional object of the invention is to provide a machine for the production of rod-shaped articles, particularly filter rod sections or filter elements, with novel and improved means for regulating the quantity of one or more components in successive increments of the rod which is produced from such components to be thereupon subdivided into sections or elements of desired length.

Another object of the invention is to provide a machine for the production of filter rod sections with novel and improved means for determining the quantity of one or more components in sections which are withdrawn directly from the stream of articles leaving the machine for transport to storage or to a consuming machine.

The method of the present invention is employed for the making of filter elements or analogous rod-shaped articles which constitute or form part of rod-shaped smokers' products and are composed of at least one main component (such as the aforementioned tow of filamentary filter material) and at least one secondary or auxiliary component (such as the aforementioned plasticizer or bonding medium), especially a secondary component which influences the condition of the main component (thus, the plasticizer softens portions of filaments and causes them to adhere to each other prior to setting). The method comprises the steps of converting effective quantities of the main and secondary components into a rod, subdividing the rod into a succession of rod-shaped articles of predetermined length, conveying the articles along a predetermined path, repeatedly removing selected articles or groups of selected articles from the path, measuring the quantity of at least one component in the thus removed articles, and regulating the quantity of at least one component in the course of the converting step in accordance with the results of measurements.

If the main component is a tow of stretchable crimped filamentary material and the regulating step includes regulating the quantity of filamentary material, the method further comprises the steps of storing a supply of filter material, continuously withdrawing from the supply a tow of filter material, and subjecting the tow to a variable stretching action to thus determine the quantity of filter material in successive increments of the tow prior to the converting step. The regulating step then comprises changing the stretching action upon the filaments of the tow in accordance with the results of measurements.

The measuring step preferably comprises producing signals which are indicative of the measured quantity, and the regulating step comprises utilizing the signals to change the stretching action when the signals deviate from a predetermined signal.

In accordance with an advantageous feature of the improved method, the measuring step comprises weighing the removed selected rod-shaped articles; such articles are preferably removed by means of one or more pneumatic ejectors which can be actuated at regular intervals or at desired intervals to expel from the path for the rod-shaped articles a desired number of articles for weighing.

If the secondary component is a liquid which is applied in the form of finely dispersed droplets, the regulating means for the secondary component may comprise a device which insures that the main component receives a predetermined quantity of secondary component per unit of time.

In accordance with a more specific feature of the invention, the method may further comprise the steps of converting effective quantities of all but one component into a second rod and subdividing the second rod into second rod-shaped articles of the same size and shape as the normally produced articles. The measuring step then comprises separately weighing equal numbers of normally produced second articles, comparing the combined weight of the normally produced articles with the combined weight of the second articles, and producing signals which are indicative of the difference between the two weights. The regulating step then comprises regulating the quantity of at least one component in the first-mentioned converting step in accordance with the signals.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
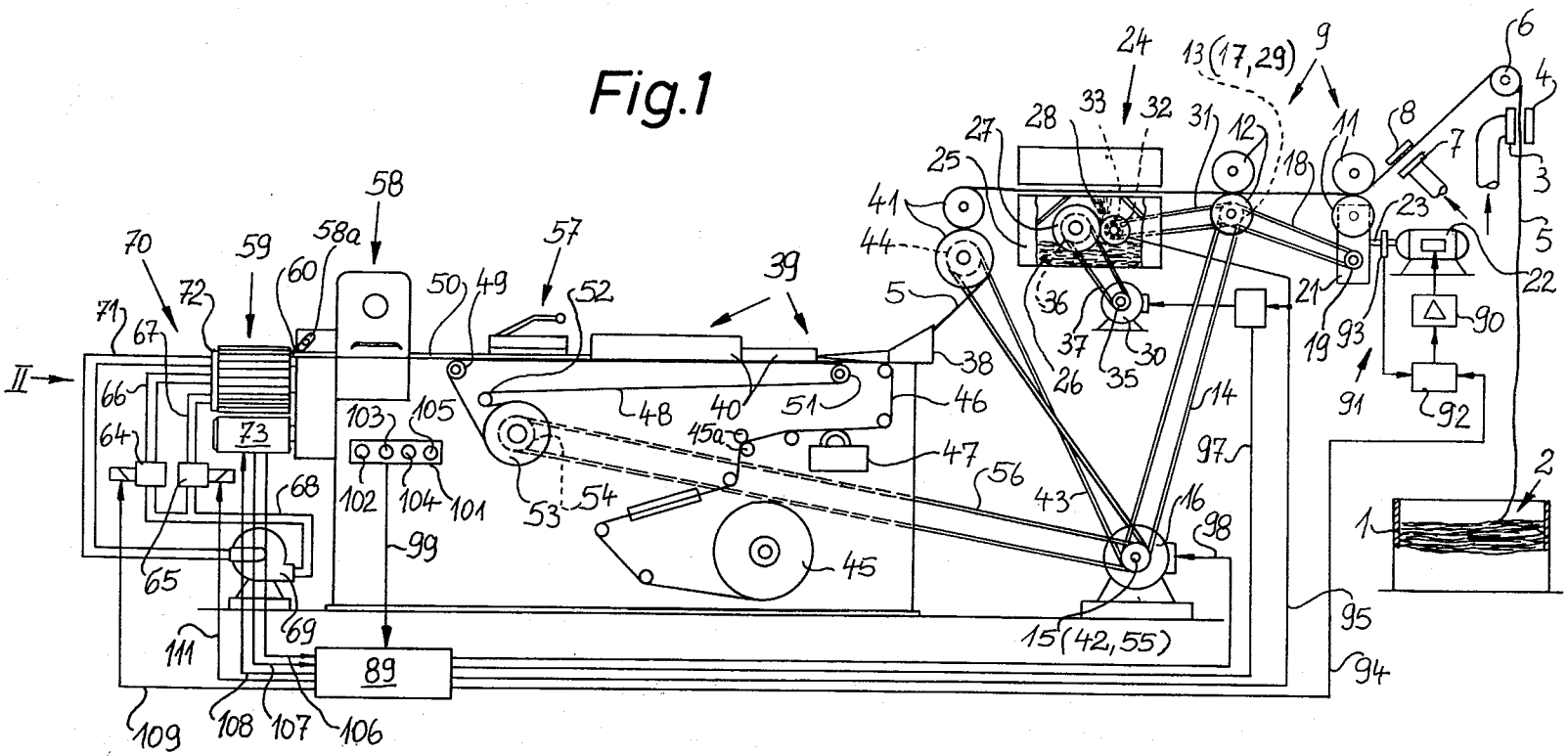
FIG. 1 is a schematic side elevational view of a filter rod making machine which embodies one form of the invention.

Referring first to FIG. 1, there is shown a filter rod making machine having a refillable receptacle 1 containing a source 2 of a tow 5 of crimped filamentary filter material which is to be converted into the filler of a continuous wrapped filter rod 50. the source 2 of filamentary material in the receptacle 1 is in the form of a bale and is drawn first upwardly and thereupon in a direction to the left by an adjustable feeding unit 9 including a pair of variable-speed advancing rolls 11. On its way toward the nip of the advancing rolls 11, the tow 5 passes along a nozzle 3 having orifices facing a plate 4 and connected to a source of compressed air to direct air streams across the path of the tow 5 in order to loosen or open the filaments and to impart to the tow the shape of a band which is thereupon caused to pass around a deflecting roller 6. A second nozzle 7 having orifices which face a plate 8 is installed between the deflecting roller 6 and the advancing rolls 11 to further loosen or open the filaments of the tow 5 before the tow undergoes a stretching or tensioning action in the zone between the advancing rolls 11 and a second pair of advancing or tensioning rolls 12 which also form part of the adjustable feeding unit 9. The tensioning rolls 12 are normally driven at a constant speed; however, the advancing rolls 11 are driven at a variable speed by a regulating unit 91 to thus determine the stretch of filaments which form the tow 5 and hence the quantity of filaments per unit length of the tow.

The drive means for the tensioning rolls 12 comprises a variable-speed electric motor 16 which drives a toothed pulley 13 on the shaft of the lower tensioning roll 12 by way of an endless toothed belt 14 trained over a toothed pulley 15 on the output shaft of the motor 16.

The advancing rolls 11 receive motion from the motor 16 by way of the belt 14, a toothed pulley 17 on the shaft of the lower tensioning roll 12, an endless toothed belt 18 which is trained over the pulley 17, and a toothed pulley 19 on the rotary input member of an infinitely variable-speed transmission 21 for the lower advancing roll 11. The latter is connected with the output member of the transmission 21 which forms part of the aforementioned regulating unit 91. The ratio of the transmission 21 can be changed by the output shaft 23 of an electric servomotor 22 which also constitutes aan element of the regulating unit 91.

The feeding unit 9 can change the quantity of the primary or main component (filamentary filter material) in successive increments or unit lengths of the wrapped filter rod 50. A secondary or auxiliary component of the filter rod is a liquid bonding medium or plasticizer 26 (e.g., triacetin) which is stored in a vessel or tank 25 forming part of a second adjustable feeding or filament-treating unit 24. The latter further comprises two applicators 27, 28 the first of which is a rotary drum dipping into the supply of plasticizer 26 in the tank 25 to withdraw a continuous film of plasticizer which is thereupon atomized by the second applicator 28, preferably a rotary brush which converts the film into a spray and directs the spray across the path for the opened or loosened band-shaped tow 5 in a region downstream of the tensioning rolls 12.

Figures 3, 4:
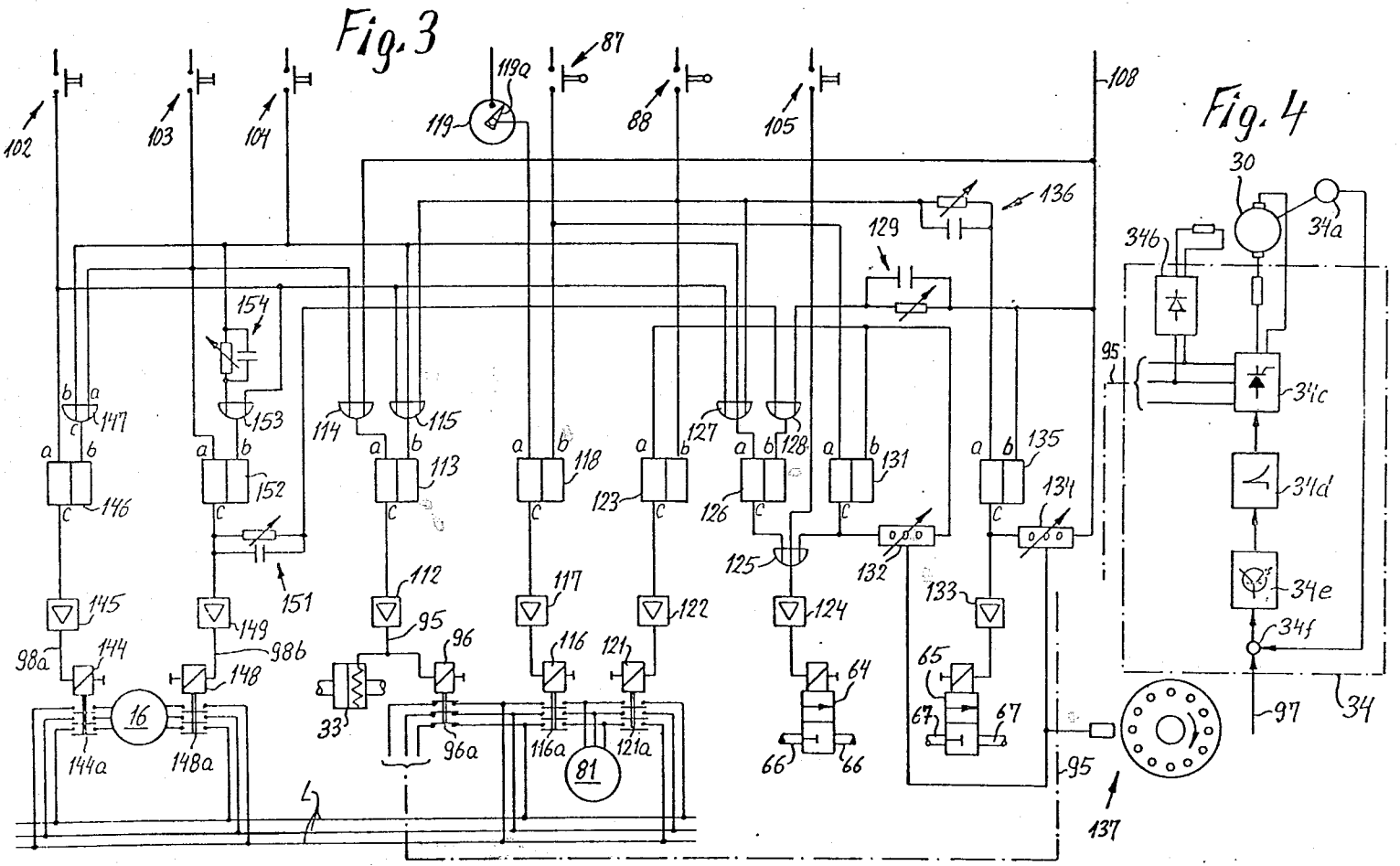
FIG. 3 is a diagram of the control circuit and of certain other parts in the machine of FIG. 1.
FIG. 4 is a diagram of one of the two regulating units in the machine of FIG. 1.

The brush 28 is driven by a toothed pullely 32 by way of an electromagnetic clutch 33 (see also FIG. 3). The pulley 32 is driven by an endless toothed belt 31 which is trained over a further toothed pulley 29 on the shaft of the lower tensioning roll 12. The drum 27 is driven by a variable-speed d-c motor 30 through the intermediary of a first toothed pulley 35 on the output shaft of the motor 30, a second toothed pulley 36 on the shaft of the drum 27, and an endless toothed belt 37. The rate at which the feeding or treating unit 24 applies the plasticizer to the tow 5 is determined by a second regulating unit 34 here shown as an electric or electronic circuit the details of which are illustrated in FIG. 4. The regulating unit 34 is of the type known as MINISEMI produced by the West-German Firm AEG. The feeding or treating unit 24 occupies a station wherein the main or primary component (tow 5) is contacted by the secondary component (plasticizer 26) prior to conversion of the thus assembled components into the wrapped filter rod 50. Such conversion begins after the properly treated tow 5 moves through and beyond the nip of two further advancing rolls 41 the lower of which has a toothed pulley 44 driven by an endless toothed belt 43. The latter is trained over a toothed pulley 42 on the output shaft of the motor 16. Successive increments of the tow 5 which advance beyond the rolls 41 are caused to pass through a condensing horn 38 which converts the tow into a rod-like filler ready to be provided with a tubular wrapper during transport through a wrapping or rod-forming station 39. This station accommodates a conventional wrapping device 40 for a web 46 of paper or cork which is stored in the form of a bobbin 45 and is being withdrawn by two advancing rolls 45*a* to travel along a paster 47 which coats at least one marginal portion or an entire surface of the web 46 with a film of adhesive before the thus coated web reaches the upper stretch of an endless band 48 which is driven by the motor 16. The band 48 is trained over several guide rollers including those numbered 49, 51, 52 and 53. The latter is driven by the motor 16 by way of a pair of toothed pulleys 54, 55 and an endless toothed belt 56.

The seam between the overlapping marginal portions of the wrapper which is obtained in response to draping of the web 46 around the filler of plasticized filaments (treated tow 5) is thereupon heated by a plate-like sealer 57 and the resulting wrapper filter rod 50 then moves into the range of an oribiting knife (not shown) forming part of a severing device 58 of the type known as cutoff and normally employed for severing of a wrapped cigarette or cigar rod in a cigarette rod or cigar rod making machine. The cutoff 58 severs the filter rod 50 at regular intervals to form a single file of filter rod sections or filter elements 60 of desired length (for example, six times unit length). A rotary accelerating cam 58*a* is mounted downstream of the cutoff 58 to accelerate successive filter rod sections 60 and to propel them into successive flutes 61 (see also FIG. 2) of an endless transporting conveyor here shown as a rotary drum 59 which is driven in synchronism with the band 48 and with the knife of the cutoff 58 and serves to advance the filter rod sections 60 along a predetermined path, namely, sideways in the form of one or more rows and on toward a further conveyor (not shown) which can be employed to deliver the filter rod sections into the magazine of a filter cigarette or filter cigar making machine, not shown, into a tray filling machine, or directly into storage.

The filter rod making machine further comprises a withdrawing unit 70 for repeatedly withdrawing from the path defined by the transporting drum 59 predetermined numbers of filter rod sections for measurement and for generation of signals which are thereupon transmitted to the regulating units 34 and 91. Such signals are employed to change the quantity of the main component (filamentary filter material) and secondary component (plasticizer 26) in the filter rod sections 60 which are permitted to leave the machine for transport to storage or to a further processing station. the withdrawing unit 70 cooperates with a measuring or weighing unit 73 which determines the quantities of components in the withdrawn rod-shaped articles and is operatively connected with the regulating units 34 and 91 by way of a control circuit 89.

The withdrawing unit 70 comprises two ejecting or segregating nozzles 62 and 63 (see FIG. 2) which are adjacent to the path of rod-shaped articles in the flutes 61 of the transporting drum 59. The nozzles 62, 63 are connected with a source of compressed air (here shown as a blower 69) through the intermediary of supply conduits 66, 67 which respectively contain normally closed electromagnetically operated valves 64, 65 (see FIGS. 1 and 3). The solenoids for the valves 64, 65 are respectively connected with adjustable counters 132, 134 shown in FIG. 3. The connection between the pressure side of the blower 69 and the supply conduits 66, 67 comprises a further supply conduit 68 shown in FIG. 1. The suction side of the blower 69 is connected with ports (not specifically shown) which communicate with the flutes 61 of the transporting drum 59 by way of a suction conduit 71 and a suitably configurated groove (not specifically shown) in a stationary valve plate 72 adjacent to one axial end of the drum 59. The arrangement is such that the transporting drum 59 normally retains by suction all such filter rod sections 60 which enter successive flutes 61 at the station accommodating the accelerating cam 58*a* and leave the respective flutes 61 at a second transfer station where such filter rod sections are removed from the drum 59 to be transported to storage or to a further processing station.

Figure 2:
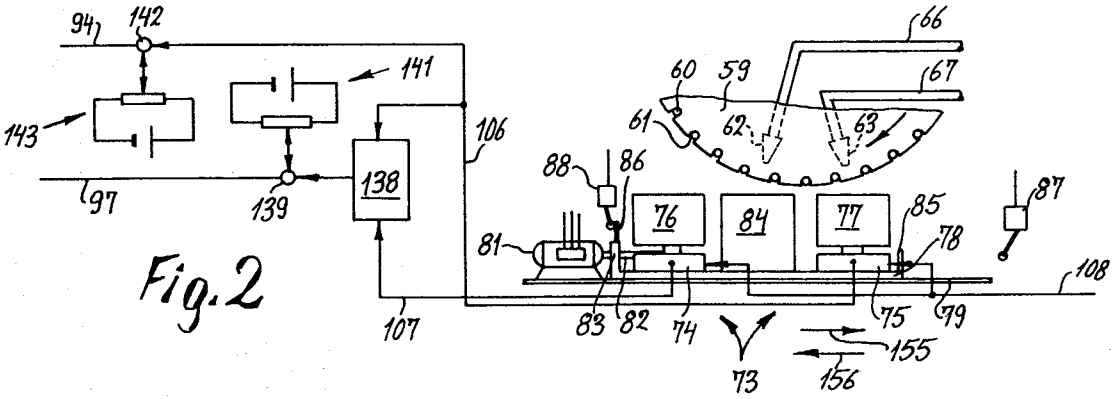
FIG. 2 is an enlarged fragmentary view of a detail substantially as seen in the direction of arrow II in FIG. 1.

The aforementioned measuring or weighing unit 73 comprises two high-precision electronic weighing devices or scales 74 and 75 (see FIG. 2) which respectively comprise article-receiving containers or trays 76, 77. An electronic weighing unit which can be used in the machine of FIG. 1 is disclosed in Canadian Pat. No. 803,371. The trays 76, 77 flank an intercepting or collecting receptacle 84 and the distance between the center of each of the trays and the center of the receptacle 84 at least approximates the distance between the ejecting nozzles 62, 63. Thus, when the tray 76 is ready to receive rod-shaped articles which are expelled from the flutes 61 by the air stream issuing from the nozzle 62, the nozzle 63 is located at a level above the receptacle 84. On the other hand, when the receptacle 84 registers with the nozzle 62 (as shown in FIG. 2), the rod-shaped articles which are being expelled from the flutes 61 by the air stream issuing from the nozzle 63 are caused to descend into the tray 77. The receptacle 84 and the trays 76, 77 are mounted on a carriage 78 which is reciprocable along a stationary guide or support 79 between the end position shown in FIG. 2 and another end position in which the tray 76 registers with the nozzle 62.

The means for reciprocating the carriage 78 with reference to the support 79 comprises a reversible electric motor 81 whose output shaft 82 constitutes a feed screw meshing with a spindle nut 83 fixed to or integral with the adjacent end of the carriage 78. If desired, the feed screw 82 can be driven by a transmission which receives torque from the output shaft of the motor 81.

The carriage 78 is provided with two actuating elements or trips 86, 85 the former of which is mounted on the nut 83 and the latter of which is mounted at the opposite end of the carriage. The trips 85, 86 respectively serve to actuate limit switches 87, 88 which are mounted adjacent to the path of the carriage 78 and are electrically connected with the solenoids for the ejecting valves 64 and 65.

As mentioned before, the regulating unit 91 for the adjustable feeding unit 9 includes the infinitely variable-speed transmission 21 and the electric servomotor 22 whose output shaft 23 can be rotated clockwise or counterclockwise to thereby change the transmission ratio and hence the speed of the feeding or advancing rolls 11. The regulating unit 91 further comprises a conventional electronic signal comparing circuit 92 whose output is connected with the servomotor 22 by way of an amplifier 90 and which has two inputs one of which is connected with the control circuit 89 by way of conductor means 94. The other input of the signal comparing circuit 92 is connected with a feeler or scanning device 93 which scans the angular position of the output shaft 23 and produces signals which are indicative of the momentary ratio of the transmission 21. The amplifier 90 is provided with conventional polarity-reversing means, such as polarized relays, which can cause the servomotor 22 to rotate its output shaft 23 in a counterclockwise direction or in a clockwise direction, depending upon whether the output signal from the signal comparing circuit 92 indicates that the ratio of the transmission 21 is to be changed in a direction to reduce or in a direction to increase the speed of the advancing or feeding rolls 11. The feeler 93 may comprise a potentiometer whose wire is stationary and whose slider is connected with the output shaft 23 to select the resistance of the potentiometer as a function of angular position of the shaft 23 and hence as a function of the momentary ratio of the transmission 21. Other types of feelers or scanning devices can be used with equal advantage.

The regulating unit 34 for the d-c motor 30 which drives the drum-shaped applicator 27 and for the clutch 33 which transmits torque to the brush-shaped applicator is shown in greater detail in FIG. 4. As mentioned before, the illustrated regulating unit 34 is a so-called MINISEMI produced by the West-German Firm AEG and is a transistorized circuit including a tachometer generator 34*a* which serves to produce signals indicating the momentary speed of the motor 30 for the applicator 27, a rectifier 34*b*, a semiconductive signal transmitting device 34*c*, a pulse shaping device 34*d*, a transistor amplifier 34*e*, and a junction 34*f* for signals coming from the tachometer generator 34*a* and from a conductor means 97. The junction 34*f* transmits signals to the amplfier 34*e*. The conductor means 97 connects the junction 34*f* of the regulating unit 34 with the control circuit 89. A further conductor means 95 connects the control circuit 89 with the clutch 33 for the applicator 28 and with one input of the regulating unit 34. The conductor means 95 is connected with the regulating unit 34 by way of a relay 96 having contacts 96*a* which can connect the elements 34*b*, 34*c* of the unit 34 with a source of polyphase current. The control circuit 89 is further connected with the motor 16 by way of a cable 98 including the conductors 98*a*, 98*b* (see FIG. 3). Still further, the control circuit 89 is connected with a control panel 101 by way of a three-conductor cable 99. The control panel 101 supports three speed changing devices in the form of pushbuttons 102, 103, 104 which can be actuated by the person in charge in order to change the speed of the motor 16. The pushbutton 102 consitutes a starting device which can initiate completion of the circuit of the motor 16 and thereby causes the motor 16 to be accelerated to the lower of two speeds. The pushbutton 103 constitutes an accelerating device which is actuated (depressed) by a person in charge in order to accelerate the motor 16 from the lower speed to a higher or normal speed. The pushbutton 104 constitutes an arresting or decelerating device for the motor 16; the latter is decelerated to zero speed within a certain interval of time when the pushbutton 104 is actuated while the motor 16 is driven at the normal speed. A further pushbutton 105 on the control panel 101 is actuated when the operator wishes to withdraw samples of rod-shaped articles 60 by way of the removing unit 70.

The control circuit 89 is further connected with the measuring unit 73 by way of conductor means 106, 107, 108. Additional conductor means 109, 111 connect the control circuit 89 with the solenoids of the valves 64, 65 in the supply conduits 66, 67 for the ejecting or segregating nozzles 62, 63 of the removing unit 70.

The details of the control circuit 89 are illustrated in FIGS. 2 and 3. That portion of the control circuit 89 which is connected with the electromagnetic clutch 33 for the applicator 28 and with the regulating unit 34 includes an amplifier 112, a signal storing circuit 113 and two logic circuits in the form of OR-gates 114, 115. That portion of the control circuit 89 which is connected with the reversible motor 81 for the carriage 78 of FIG. 3 includes a relay 116, an amplifier 117, a signal storing circuit 118, an adjustable clockwork mechanism or timer 119, the aforementioned limit switches 87, 88, a further relay 121, a further amplifier 122, and a further signal storing circuit 123. That branch or portion of the control circuit 89 which is connected with the solenoid for the valve 64 includes an amplifier 124, or OR-gate 125, a signal storing circuit 126, additional OR-gates 127, 128, an adjustable time-delay device 129, a further signal storing circuit 131, the aforementioned counter 132 and the pushbutton 105. The control circuit branch which is connected with the solenoid for the valve 65 includes an amplifier 133, the aforementioned counter 134, a signal storing circuit 135 and an adjustable time-delay device 136. The counters 132, 134 can be considered as constituting component parts of the control circuit 89 or of the removing unit 70; they are associated with a timer or pulse generator 137 of conventional design which is rotated in synchronism with the transporting drum 59 and transmits to the counters 132 and 134 signals at intervals which correspond to intervals between introduction of successive filter rod sections into the flutes 61 of the drum 59.

That portion or branch of the control circuit 89 which is connected with the measuing unit 73 includes a differential circuit 138 (FIG. 2), a signal comparing junction 139 and a potentiometer 141 which is adjustable to furnish to the junction 139 a signal of preselected magnitude or intensity, a second adjustable potentiometer 143, and a further junction 142 which is connected with the conductor means 94, with the conductor means 106 and with the potentiometer 143. The junction 139 is connected with the conductor means 97, with the potentiometer 141 and with the output of the differential circuit 138.

That branch or portion of the control circuit 89 which is connected with the speed changing devices 102, 103, 104 for the motor 16 comprises a relay 144, an amplifier 145, a signal storing circuit 146, an OR-gate 147, a further relay 148, a further amplifier 149, an adjustable time-delay device 151, a further signal storing circuit 152, a further OR-gate 153 and a further adjustable time-delay device 154. Each of the OR-gates (see, for example, the OR-gate 147 of FIG. 3) has two inputs *a*, *b* and an output *c*. The output *c* transmits a signal as long as at least one of the inputs *a*, *b* receives a signal. Each signal storing circuit (see, for example, the circuit 146 of FIG. 3) has a first input *a* which causes the output *c* to transmit a signal until the other input *b* receives an erasing signal. Thus, the output *c* of each signal storing circuit transmits a signal in response to momentary or continued reception of a signal at the input *a* and the transmission of the signal continues until the input *b* receives an erasing signal.

The operation:

It is assumed that the filter rod making machine operates normally, i.e., that the motor 16 drives the belts 14, 43 and 56 at the higher of two speeds. The feeding or advancing rolls 11 draw the tow 5 at the normal speed and the applicators 27, 28 cooperate to apply an average quantity of atomized plasticizer 26 to each unit length of the tow. The carriage 78 dwells in the end position shown in FIG. 2 in which the nozzles 62, 63 respectively register with the receptacle 84 and tray 77.

The timer 119 serves to trigger or initiate successive measuring operations at preselected intervals. This timer can constitute a clockwork mechanism which completes a circuit whenever its pointer 119*a* reaches the 12-o'clock position to thus cause the transmission of a signal to the input *a* of the signal storing circuit 118. For example, the clockwork mechanism 119 may be adjusted in such a way that the input *a* of the signal storing circuit 118 receives a signal every thirty minutes. The output *c* of the circuit 118 then transmits a signal to the amplifier 117 which energizes the realy 116 so that the latter closes its contacts 116*a* and connects one winding of the reversible motor 81 with a source of energy by way of power leads L. The motor 81 is started and begins to move the carriage 78 along the support 79 in the direction indicated by the arrow 155 shown in FIG. 2. The trip 85 actuates the limit switch 87 when the carriage 78 reaches its second end position in which the nozzles 62, 63 respectively register with the tray 76 and receptacle 84. The limit switch 87 transmits a signal to the input *b* of the signal storing circuit 118 whereby the circuit 118 ceases to energize the relay 116 by way of the amplifier 117 so that the motor 81 comes to a halt.

The closing of the limit switch 87 by the trip 85 further results in transmission of a signal to the input *a* of the signal storing circuit 131 whose output *c* transmits a signal to the amplifier 124 by way of the corresponding input and the output of the OR-gate 125. The amplifier 124 energizes the solenoid for the valve 64 which enables the conduit 66 to convey to the nozzle 62 a stream of compressed air to expel filter rod sections 60 from successive flutes 61 of the transporting drum 59 and to propel such filter rod sections into the tray 76 of the scale 74. Each expelled filter rod section 60 is of the same quality of consistency as the preceding non-expelled filter rod sections, i.e., each expelled filter rod section contains the same quantity of plasticizer 26 and filamentary material as the preceding filter rod sections 60 which were permitted to bypass the ejecting or removing station (nozzle 62). Thus, the expelled filter rod sections in the tray 76 are representative of the quality of filter rod sections which are being produced by the machine at the time when the clockwork mechanism 119 produces a signal or causes the generation of a signal for energization of the relay 116 and for delayed energization of the solenoid for the valve 64 by means of the limit switch 87. The number of filter rod sections 60 which are expelled into the tray 76 depends on the setting of the counter 132 which is started in response to the signal from the output *c* of the signal storing circuit 131 simultaneously with opening of the valve 64, i.e., in response to closing of the limit switch 87. The counter 132 counts the signals which are transmitted thereto by the timer 137; when the counter 132 receives *n* signals (*n* being the desired number of filter rod sections 60 which are to be expelled into the tray 76), it transmits a signal to the erasing input *b* of the signal storing circuit 131 whereby the latter terminates the transmission of a signal to the amplifier 124 (by way of the OR-gate 125) so that the valve 64 closes and terminates the flow of compressed air to the nozzle 62. The counter 132 is automatically reset to zero when it ceases to receive a signal from the output *c* of the signal storing circuit 131.

The output signal from the counter 132 is further transmitted to the input *a* of the signal storing circuit 123 whose output *c* energizes the realy 121 by way of the amplifier 122. The relay 121 closes its contacts 121*a* to thus connect the power leads L with the other winding of the motor 81. This motor begins to move the carriage 78 back to the end position shown in FIG. 2 (see the arrow 156). The transmission of motion from the motor 81 to the carriage 78 takes place by way of the feed screw 82 and nut 83. During movement of the carriage 78 back to the end position shown in FIG. 2, the transporting porting drum 59 is free to deliver the filter rod sections 60 (namely, those sections immediately following the sections which were caused to enter the tray 76 of the scale 74) to their normal destination, e.g., into a tray filling machine, not shown.

When the carriage 78 reaches the end position of FIG. 2, the trip 86 actuates (closes) the limit switch 88 which transmits a signal to the erasing input *b* of the signal storing circuit 123 whereby the latter deenergizes the relay 121 and arrests the motor 81. At the same time, the signal which is generated in response to actuation of the limit switch 88 reaches the erasing input *b* of the signal storing circuit 113 by way of the OR-gate 115. The output *c* of the signal storing circuit 113 ceases to transmit a signal to the amplifier 112 so that the clutch 33 is deenergized to stop the applicator 28 and the relay 96 is deenergized to open the circuit of the motor 30 for the applicator 27. Thus, the connection between the control circuit 89 and the regulating unit 34 is interrupted. The feeding unit 24 for the plasticizer 26 is idle. It will be seen that the limit switch 88 constitutes a means for temporarily arresting the feeding unit 24 to start the production of filter rod sections without plasticizer.

The signal which is generated in response to actuation of the limit switch 88 is further transmitted to the input *a* of the signal storing circuit 126 by way of the OR-gate 127. The output *c* of the circuit 126 energizes the solenoid for the valve 64 by way of the amplifier 124 and OR-gate 125 so that the valve 64 permits the flow of compressed air to the nozzle 62. The signal which is generated in response to actuation of the limit switch 88 is also transmitted, with a delay determined by the device 136, to the input *a* of the signal storing circuit 135. Since the valve 64 is open, the nozzle 62 expels into the receptacle 84 all such filter rod sections which are produced and reach the transporting drum 59 while the signal storing circuit 126 remains operative. The signal from the output *c* of the signal storing circuit 135 not only causes opening of the valve 65 but also starts the counter 134. The counter 134 receives pulses from the timer 137 and counts such pulses to transmit a signal to the erasing input *b* of the signal storing circuit 135 and to thus effect a closing of the valve 65 when the nozzle 63 completes the ejection of a predetermined number of filter rod sections into the tray 77 of the scale 75. It will be noted that the nozzle 63 is located ahead of the nozzle 62, as considered in the direction of rotation of the transporting drum 59. The tray 77 receives filter rod sections which do not contain any plasticizer because such sections are produced subsequent to deactivation of the feeding unit 24. The counter 134 is reset to zero when the emission of a signal at the output *c* of the signal storing circuit 135 is terminated. The signal from the counter 134 is further transmitted to the input *a* of the signal storing circuit 113 by way of the OR-gate 114 whereby an amplifier 112 energizes the clutch 33 and the relay 96 which latter connects the motor 30 in the regulating unit 34 with the energy source. Thus, the applicators 27, 28 of the feeding unti 24 are operative and begin to spray atomized plasticizer 26 against successive increments of the tow 5. The construction of the counter 134 is preferably identical with that of the counter 132.

The output signal from the counter 134 is further transmitted to the input *b* of the signal storing circuit 126 by way of the time-delay device 129 and OR-gate 128. Thus, the solenoid for the valve 64 is deenergized by way of the OR-gate 125 and amplifier 124 so that the valve 64 closes and disconnects the blower 69 from the nozzle 62.

The adjustment of the time-delay device 129 is such that the nozzle 62 ceases to expel filter rod sections from the adjacent flutes 61 of the drum 59 with a delay which is necessary in order to insure that the nozzle 62 expels all such filter rod sections which were produced while the feeding unit 24 was idle, i.e., all such filter rod sections which do not contain an effective quantity of plasticizer 26.

As shown in FIGS. 2 and 3, the output signal from the counter 134 is further transmitted to the scales 74, 75 by way of the conductor means 108. The transmission of such signal to the two scales takes place at a time when the tray 76 already accommodates a predetermined number of filter rod sections which contain the main component (filaments) and the secondary component (plasticizer 26) and when the tray 77 accommodates filter rod sections which contain the main component but not the plasticizer. The number of filter rod sections in both trays is preferably the same. The scales 74, 75 then produce voltage pulses which are transmitted to the corresponding inputs of the differential circuit 138 by way of the conductor means 106, 107 (see FIG. 2). The intensity of pulses is respectively indicative of the combined weight of filter rod sections with and without plasticizer 26. The circuit 138 computes the incoming pulses and transmits a signal which is indicative of the difference between the two pulses. Such signal reaches the junction 139 which compares the thus received signal with that from the potentiometer 141. The signal from the potentiometer 141 is indicative of desired intensity of the signal from the output of the differential circuit 138. In the case of a difference between the intensities of the two signals which are transmitted to the junction 139, the latter transmits a signal to the junction 34*f* of the regulating unit 34 by way of the conductor means 97. The regulating unit 34 then selects a different speed for the motor 30 to thus insure that the rate at which the feeding unit 24 furnishes atomized plasticizer 26 to successive increments of the tow 5 is a function of the intensity of the signal furnished by the potentiometer meter 141. The adjusted speed of the motor 30 remains unchanged during the interval between two successive signals from the clockwork mechanism 119. The changes in speed of the motor 30 immediately result in a change of the rate of application of atomized plasticizer 26 because the applicator 27 withdraws more or less plasticizer from the supply in the tank 25, depending on an increase or a reduction in the speed of the motor 30. The acceleration or deceleration of the motor 30 depends on the sign of the signal which is furnished by the junction 139 to the junction 34*f* of the regulating unit 34.

The signal from the scale 75 is indicative of the combined weight of filter rod sections (without plasticizer 26) in the tray 77 and is transmitted by the conductor means 106 to the corresponding input of the differential circuit 138 as well as to one input of the signal comparing junction 142. The latter receives from the potentiometer 143 a signal which is indicative of the desired weight of filter rod sections without plasticizer (i.e., of the quantity of main component in each filter rod section). In the case of a difference between the intensities of signals which reach the junction 142, the latter transmits a signal to the corresponding input of the signal comparing circuit 92 in the regulating unit 91 (by way of the conductor means 94), and the thus transmitted signal causes appropriate modification of the signal to the amplifier 90 which causes the motor 22 to bring about an appropriate change in the ratio of the transmission 21 for the advancing or feeding rolls 11. Thus, the speed at which the rolls 11 draw the tow 5 from the receptacle 1 is changed in dependency on the nature of the signal from the junction 142 so that the tension of the tow in the zone between the rolls 11 and 12 changes with the result that the quantity of filter material per unit length of the tow conforms to the quantity indicated by the signal from the potentiometer 143. The thus selected speed at which the advancing rolls 11 draw the tow 5 from the receptacle 1 remains unchanged during the interval between two successive signals from the clockwork mechanism 119. The adjustment of the ratio of transmission 21 is terminated when the feeler 93 transmits to the corresponding input of the circuit 92 a signal which indicates that the momentary ratio equals the desired ratio (signal from the junction 142). The motor 22 can rotate its output shaft 23 in either direction, depending on the (positive or negative) sign of the signal from the junction 142. If the weight of filter rod sections in the tray 77 exceeds a weight which is indicated by the signal from the potentiometer 143, the regulating unit 91 reduces the speed of the advancing rolls 11 so that the tow 5 is subjected to a more intensive stretching action and thereupon contains a reduced quantity of filaments per unit length. Inversely, the regulating unit 91 increases the speed of the advancing rolls 11 and thus reduces the stretch upon filaments if the signal from the scale 75 indicates that the combined weight of filter rod sections (without plasticizer) in the tray 77 is less than indicated by the signal from the potentiometer 143. The signal at the output of the circuit 92 disappears when the ratio of the transmission 21 is a function of the signal from the potentiometer 143, and the motor 22 is then arrested. It will be seen that the change in tensioning of the tow 5 in the zone between the rolls 11 and 12 is a function of the difference between a signal from the scale 75 which indicates the weight of a predetermined number of filter rod sections without plasticizer and the signal from the potentiometer 143. Analogously, the change in the rate of application of the plasticizer 26 is a function of the difference between the signal from the scale 74 and the signal from the potentiometer 141. Consequently, the average quantity of filter material and plasticizer in each filter rod section which is permitted to leave the machine by the normal route is within a desired range because periodic adjustments by the regulating units 91 and 34 insure that deviations from the desired weight cannot last longer than the length of an interval between successive signals from the clockwork mechanism 119. The quantities of filter material and plasticizer are selected with a view to insure that the density and firmness of each finished filter rod section 60 are best suited for appropriate filtering of smoke when the filter rod sections are united with sections of wrapped tobacco rods in a machine for the production of filter-tipped cigarettes, cigars or cigarillos.

As mentioned before, the removing or withdrawing unit 70 automatically segregates or expels those filter rod sections which are produced while the speed of the motor 16 is being changed from zero speed to a lower speed, from a lower speed to a higher speed, and from a higher or lower speed to zero speed. This is achieved as follows:

When the operator actuates the starting pushbutton 102 while the motor 16 is idle, the signal which is generated in response to actuation of the pushbutton 102 is transmitted to the input *a* of the signal storing circuit 146 to cause energization of the relay 144 by way of the amplifier 145. The relay 144 moves its contacts 144*a* to closed positions to thereby connect a first winding of the motor 16 with the energy source by way of power leads L. The motor 16 is accelerated to the lower of two speeds within a certain interval of time. Even though the motor 16 is running, the feeding unit 24 is inactive because the clutch 33 and the relay 96 are deenergized so that the applicators 27 and 28 are at a standstill.

The signal which is generated in response to actuation of the starting pushbutton 102 is further transmitted to the input *a* of the signal storing circuit 126 by way of the OR-gate 127. Therefore, the circuit 126 causes energization of the solenoid for the valve 64 by way of the OR-gate 125 and amplifier 124. The nozzle 62 receives compressed air and expels successive filter rod sections (which are without plasticizer because the feeding unit 24 is idle) into the receptacle 84. The ejection of filter rod sections into the receptacle 84 is continued as long as the motor 16 is operated at the lower of two speeds. This is obviously desirable since the filter rod sections which are produced during such stage of operation are without plasticizer.

When the operator thereupon decides to actuate the accelerating pushbutton 103, the input *b* of the signal storing circuit 146 receives a signal by way of the OR-gate 147 whereby the circuit 146 deenergizes the relay 144 to disconnect the first winding of the motor 16 from the energy source. At the same time, the signal which is generated on actuation of the pushbutton 103 reaches the input *a* of the signal storing circuit 152 whose output *c* transmits a signal to the amplifier 149 to energize the relay 148 which closes its contacts 148*a* and thus connects the energy source (leads L) with the second winding of the motor 16. The latter is thereby accelerated from the lower to the higher or normal speed. Such acceleration takes up a certain interval of time.

The input *a* of the signal storing circuit 152 receives a signal simultaneously with the input *a* of the signal storing circuit 113. Therefore, the amplifier 112 energizes the clutch 33 and the relay 96 to couple the rotating pulley 32 to the applicator 28 and to connect the motor 30 with the energy source whereby the applicators 27, 28 begin to spray atomized plasticizer 26 against successive increments of the tow 5 while such increments pass through the feeding unit 24. The input *a* of the signal storing circuit 113 receives the signal from the pushbutton 103 by way of the OR-gate 114. The connection of the second winding of the motor 16 with the energy source takes place simultaneously with deenergization of the relay 144 so that the motor 16 is accelerated, without any delay, from the lower speed to the higher speed which is needed to insure that each increment of the tow 5 receives an optimum percentage of plasticizer. Thus, successive increments of the tow 5 are not expected to receive an optimum quantity of plasticizer during the interval which elapses between energization of the relay 148 and the completed acceleration of motor 16 to the higher speed. Therefore, it is desirable to continue with the ejection of filter rod sections until the filter rod sections which reach the nozzle 62 invariably contain optimum quantities of plasticizer.

The solenoid for the valve 64 (nozzle 62) is deenergized in response to a signal from the output *c* of the signal storing circuit 152 but with a delay which is determined by the time-delay device 151 which transmits the delayed signal to the erasing input *b* of the signal storing device 126 by way of the OR-gate 128. Thus, the valve 64 closes and the filter rod sections 60 can travel past the nozzle 62 without being expelled into the receptacle 84. The machine then continues to turn out satisfactory filter rod sections 60 as long as the energy source remains connected with the second winding of the motor 16 (relay 148) and with the motor 30 for the applicator 27. Thus, the feeding unit 24 is operative and each increment of the tow 5 (which is subjected to a requisite stretching action during travel in the zone between the rolls 11 and 12) is provided with a predetermined quantity of plasticizer 26. As mentioned above, the closing of the valve 64 takes place with a delay which is determined by the time-delay device 151 and is preferably selected in such a way that the valve 64 closes subsequent to acceleration of the motor 16 to normal speed and by further insuring that all filter rod sections which do not as yet contain the desired quantity of plasticizer are expelled into the receptacle 84.

If the operator actuates the arresting pushbutton 104 while the motor 16 is operated at the lower speed (in response to actuation of the pushbutton 102), the OR-gate 147 transmits a signal to the erasing input *b* of the signal storing circuit 146 so that the latter deenergizes the relay 144 and causes immediate stoppage of the motor 16.

If the arresting pushbutton 104 is actuated while the motor 16 is operated at the normal or higher speed, the OR-gate 115 transmits a signal to the erasing input *b* of the signal storing circuit 113 which deenergizes the clutch 33 and the relay 96 by way of the output *c* and amplifier 112 to immediately arrest the applicators 27 and 28. At the same time, the OR-gate 127 immediately transmits a signal to the input *a* of the signal storing circuit 126 which energizes the solenoid for the valve 64 so that the nozzle 62 begins to expel filter rod sections into the receptacle 84. The signal from the pushbutton 104 is further transmitted to the erasing input *b* of the signal storing circuit 152 by way of the OR-gate 153 with a delay which is determined by the time-delay 154. Therefore, the signal at the output *c* of the signal storing circuit 152 disappears to deenergize the relay 148 with such a delay that the nozzle 62 invariably expels into the receptacle 84 all filter rod sections which are produced subsequent to deactivation of the feeding unit 24. Thus, the machine does not contain any such portions of the tow 5 which are treated with plasticizer 26 when the motor 16 is idle. This eliminates problems during starting of the motor 16 when the production is resumed.

It will be seen that the machine is arrested immediately if the pushbutton 104 is actuated while the motor 16 is running at the lower speed. This is due to the fact that the feeding unit 24 is then idle so that the tow which remains in the machine when the motor 16 is idle does not contain any plasticizer. On the other hand, when the pushbutton 104 is actuated while the motor 16 is running at full speed, stoppage of the motor 16 (deenergization of the relay 148 and opening of contacts 148*a*) takes place with a delay (device 154) which is long enough to insure that the nozzle 62 expels all filter rod sections which might contain at least some plasticizer. Therefore, the tow which remains in the machine while the motor 16 is idle is always free of plasticizer to thus insure that the machine can be started without any difficulties which normally arise if the starting takes place while the wrapping mechanism and/or other parts of the machine contain portions of tow which are impregnated with hardened plasticizer. The feeding unit 24 is deactivated in immediate response to actuation of the pushbutton 104 while the motor 16 is running at normal speed. The feeding unit 24 is not active when the motor 16 is running at the lower speed; therefore, the motor 16 can be arrested in immediate response to actuation of the pushbutton 104.

If an operator wishes to withdraw samples of filter rod sections 60 at a time other than that determined by the clockwork mechanism 119, for example, to examine the appearance of filter rod sections, the operator actuates the pushbutton 105 to transmit a signal to the amplifier 124 directly through the OR-gate 125 so that the amplifier 124 energizes the solenoid for the valve 64 which opens and enables the nozzle 62 to expel successive filter rod sections 60 from the flutes 61 of the transporting drum 59 into the receptacle 84. The ejection of sections 60 into the receptacle 84 continues as long as the operator maintains the pushbutton 105 in depressed position. Thus, the machine permits withdrawal of any desired number of samples at any desired time, merely by depressing the pushbutton 105 while the motor 16 continues to run at the normal speed.

The provision of a regulating unit 91 for the feeding unit 9 which controls the quantity of filamentary filter material per unit length of the tow 5 is particularly important because the filamentary material constitutes the main component of each filter rod section 60. Reliable operation of the regulating unit 91 is also important because the weight of successive increments of the tow 5 is much more likely to fluctuate within a very wide range than the quantity of plasticizer per unit length of the tow since the filaments are crimped and the number of crimps is likely to vary from filament to filament as well as between successive lengths of a single filament. However, the accuracy of regulating action upon the feeding unit 9 cannot be increased beyond a certain limit, mainly due to technological reasons as well as due to inertia of moving parts and limits in the accuracy of finish of machine parts. Therefore, it is desirable to provide the machine with discrete regulating means for each component of the filter rod or at least for the two most important components (filter material and plasticizer). The quantity of plasticizer per unit length of the tow 5 is likely to fluctuate for a number of reasons. For example, if the opening or spreading action of nozzle 3 and 7 is not uniform, the tow 5 is likely to reach the feeding unit 24 in the form of a band whose width varies from increment to increment and, therefore, the band will intercept different quantities of atomized plasticizer during travel past the applicators 27 and 28. The differences in width of the opened tow during transport through the feeding unit 24 are likely to influence the weight of the filter rod sections 60. The quantity of applied plasticizer is also likely to fluctuate due to temperature changes which influence the viscosity of the supply in the tank 25. Furthermore, the atomizing action of the applicator 28 is affected by wear on its bristles. Thus, there are many reasons to warrant a measurement of the quantity of plasticizer in the filter rod sections 60 which are about to leave the machine and to regulate the feeding unit 24 in accordance with signals which are being transmitted to the regulating unit 34.

The weighing unit 70 is but one of several measuring units which can be utilized in the machine of the present invention. As a matter of fact, certain other types of measuring means (such as devices which employ beta rays and ionization chambers) exhibit the advantage that they can continuously measure the quantity of one or more components in successive increments of the rod 50 so that the removing or withdrawing means 73 can be dispensed with. The same holds true for aforementioned pneumatic measuring or detecting devices which determine the resistance offered by successive increments of the tow to the passage of an air stream. It is further possible to employ a pair of electrodes which are connected with a source of high-frequency current and are placed at the opposite sides of the path for the filter rod 50 or filter rod sections 60. Nevertheless, one or more precision weighing devices are preferred at this time because they are capable of determining the quantities of one or more components with an extremely high degree of accuracy, especially if the articles are not weighed singly but in groups each of which consists of a substantial number of articles. Removal of groups at predetermined intervals in response to signals from the clockwork mechanism or timer 119 is advantageous because the samples can be withdrawn automatically without necessitating any attention on the part of the operators.

As desired above, the machine of FIGS. 1 to 4 is provided with two regulating units 91 and 34 which respectively adjust the feeding unit 9 for the tow 5 (main component) and the feeding unit 24 (source of the secondary component 26). However, it is equally within the purview of the invention to modify the machine of FIGS. 1 to 4 in such a way that the regulating unit 91 is either omitted or rendered inactive so that the advancing rolls 11 are driven at a constant speed and the regulating unit 34 adjusts the rate of application of the plasticizer 26 in response to signals by way of the conductor means 97. In addition to omission or deactivation of the regulating unit 91, the thus simplified machine can operate properly by omitting the junction 142, the potentiometer 143 and the conductor means 94. Also, the transmission 21 can be replaced with a simpler transmission. In all other respects, the operation of the thus modified machine is clearly analogous to operation of the machine shown in FIGS. 1 to 4.

Figure 5:
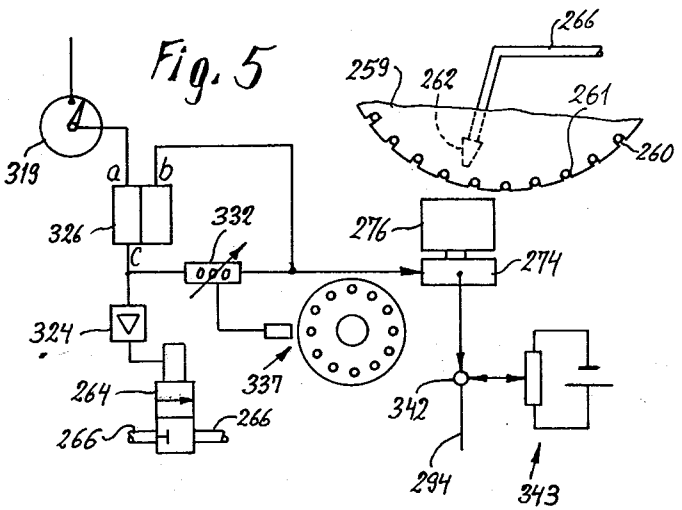
FIG. 5 is a fragmentary detail view, similar to that of FIG. 2, of a portion of a modified filter rod making machine.

If it is desired to use a feeding unit which is designed to furnish a constant quantity of plasticizer 26 per unit of time, i.e., to operate the machine with the regulating unit 91 but without the regulating unit 34, the regulating unit 34 can be deactivated or omitted together with the scale 74, and the other scale can be fixedly mounted to receive filter rod sections in response to operation of the withdrawing or removing unit. A portion of such modified machine is shown in FIG. 5. All such parts of the structure shown in FIG. 5 which are identical with or clearly analogous to the corresponding parts of the machine shown in FIGS. 1 to 4 are denoted by similar reference characters plus 200.

The withdrawing or removing unit of FIG. 5 comprises a single ejector nozle 262 which is connected with a source of compressed air by way of a supply conduit 266 and is adjacent to the path of filter rod sections 260 which travel in the flutes 261 of the transporting drum 259. The valve 264 in the supply conduit 266 is normally closed and its solenoid is energized in response to a signal from the timer or clockwork mechanism 319 by way of the signal storing circuit 326 and amplifier 324. The clockwork mechanism 319 is connected with the input *a* and the amplifier 324 is connected with the output *c* of the circuit 326. The output *c* is further connected with an adjustable pulse counter 332 which receives pulses from a timer 337 at a frequency which is proportional to the rate of travel of flutes 261 past the nozzle 262. The output of the counter 332 is connected with the erasing input *b* of the signal storing circuit 326 and with the scale 274 which is stationary and whose tray 276 is positioned to intercept filter rod sections which are expelled by the air stream issuing from the nozzle 262. The scale 274 transmits signals to a junction 342 which is connected with the regulating unit 91 (not shown) by way of a conductor means 294 and with a potentiometer 343 which corresponds to the potentiometer 143 of FIG. 2.

The clockwork mechanism 319 is set to transmit to the input *a* of the signal storing circuit 326 signals predetermined intervals, for example, every hour or every thirty minutes. The output *c* of the circuit 326 then transmits a signal which energizes the solenoid for the valve 264 by way of the amplifier 324 and which also starts the properly adjusted pulse counter 332. The latter counts the pulses which are transmitted by the timer 337 at the rate at which the nozzle 262 expels filter rod sections 260 from the flutes 261 of the drum 259 into the tray 276. When the counter 332 receives a preselected number of pulses, i.e., when the tray 276 accumulates a predetermined number of filter rod sections 260, the output of the counter 332 transmits a signal to the input *b* of the signal storing circuit 326 to erase the signal at the output *c* and to thus deenergize the solenoid for the valve 264 with resulting deactivation of the withdrawing unit. At the same time, the counter 332 transmits a signal to the scale 274 which determines the combined weight of filter rod sections 260 in the tray 276 and transmits an appropriate signal to the junction 342. The latter compares such signal with the signal from the potentiometer 343 (i.e., with a signal which is indicative of the desired weight of filter rod sections 260 in the tray 276), and the conductor means 294 transmits (if necessary) a signal to the regulating unit 91 so that the unit 91 adjusts the stretch of successive portions of the tow 5 between the advancing rolls 11 and 12. The scale 274 can complete the weighing operation prior to or in response to reception of a signal from the counter 332.

An important advantage of the improved method is that the quality and consistency of filter rod sections which reach a processing machine (e.g., a filter cigarette making machine) is much more uniform than in presently known filter rod making machines and also that the number of rejects is reduced considerably because any adjustments which might become necessary are carried out without requiring any attention on the part of the operators. The consistency of a satisfactory filter rod section is preferably uniform all the way from the one end to the other end, and this can be readily achieved by automatically regulating the quantity of at least one component of each filter rod section and by insuring the expulsion or segregation of all such filter rod sections which are produced during those stages of operation when the machine is likely to turn out unsatisfactory products. Another important advantage of the improved method is that it can be rapidly converted from the production of a first type of rod-shaped articles to the production of any one of several other types of articles merely by changing the plasticizer in the tank 25, by replacing the bale 2 with a bale consisting of or containing another material, by adjusting the potentiometer 141, and/or by adjusting the potentiometer 143 (343). An advantage of the aforedescribed measuring, feeding, regulating and removing units is that they can be built into or combined with existing types of filter rod making machines or other machines wherein two or more components are to be assembled or brought in contact with each other in accurately metered quantities. Since the articles to be weighed are removed directly from the path wherein the articles normally travel toward the outlet of the machine, the weighed articles are truly representative of the quality of the output of the machine.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A method of collecting samples of filter rod elements or analogous rod-shaped articles which are composed of at least one main component and at least one secondary component, particularly a secondary component which influences the condition of the main component, comprising the steps of converting first and second effective quantities of main and secondary components into a first rod; subdividing the first rod into a succession of first rod-shaped articles each having a predetermined length; conveying the first rod-shaped articles along a predetermined path; reducing the quantity of second component in said converting step to zero in response to a first signal so that said converting and subdividing steps thereupon respectively result in the making of a second rod and a succession of second rod-shaped articles which are devoid of said secondary component; removing second rod-shaped articles from a predetermined portion of said path in response to a second signal which is produced with a delay following said first signal; and increasing the quantity of said secondary component in said converting step to said second effective quantity in response to a third signal which is produced with a delay following said second signal.

2. A method as defined in claim 1, further comprising the steps of removing first rod-shaped articles from a second predetermined portion of said path in response to said first signal and terminating said last mentioned removing step in response to a fourth signal which is produced with a delay following said third signal.

3. A method as defined in claim 2, wherein said second portion of said path is located behind of said first mentioned portion, as considered in the direction of movement of rod-shaped articles along said path.

4. A method as defined in claim 1, further comprising the step of terminating said removing step in response to an additional signal produced with an additional delay which follows said second signal and is a function of the speed of movement of articles along said path so that said removing step results in removal of a predetermined number of second rod-shaped articles from said portion of said path.

5. A method as defined in claim 1, further comprising the step of producing said second and third signals in automatic response to the production of said first signal.

6. In a machine for the production of filter elements or analogous rod-shaped articles which are composed of at least one main component and at least one secondary component, particularly a secondary component which influences the condition of the main component, a combination comprising discrete sources of main and secondary components; discrete first and second feeding means for supplying effective quantities of main and secondary components from the respective sources to a treating station; means for converting the thus treated components into a first continuous rod; means for subdividing the first rod into a succession of first rod-shaped articles each having a predetermined length; means for conveying the first articles along a predetermined path; means for producing a first signal; means for interrupting the operation of said second feeding means in response to said first signal so that said converting means thereupon produces a second rod and said subdividing means subdivides the second rod into a succession of second rod-shaped articles which are devoid of said secondary component; means for producing a second signal with a delay following the production of said first signal; means for expelling rod-shaped articles from a predetermined portion of said path in response to said second signal, said delay being such that said expelling means expels only second rod-shaped articles from said portion of said path; means for producing a third signal with a delay following said second signal; and means for effecting renewed operation of said second feeding means in response to said third signal.

7. A combination as defined in claim 6, further comprising means for deactivating said expelling means, including a counter operable in synchronism with the speed of movement of rod-shaped articles along said path and means for starting said counter in response to said second signal.

8. A combination as defined in claim 6, further comprising means for expelling first rod-shaped articles from a second predetermined portion of said path in response to said first signal, means for producing a fourth signal with a delay following said third signal, and means for deactivating said last mentioned expelling means in response to said fourth signal.

9. A combination as defined in claim 8, wherein said first mentioned portion of said path is located ahead of said second portion, as considered in the direction of movement of rod-shaped articles along said path.

10. A combination as defined in claim 8, wherein at least one of said expelling means comprises a pneumatic ejector.

11. A combination as defined in claim 6, wherein said conveying means comprises a rotary drum-shaped member having peripheral flutes which transport rod-shaped articles sideways, said expelling means comprising a pneumatic ejector operable to expel rod-shaped articles from successive flutes in said portion of said path.

12. A combination as defined in claim 6, wherein at least one of said means for producing said second and third signals includes a time-delay device and further comprising means for connecting said time-delay device with said means for producing said first signal.

* * * * *

UNITED STATES PATENT OFFICE

CERTIFICATE OF CORRECTION

Patent No. 3,974,007 Dated August 10, 1976

Inventor(s) Heinz Greve

It is certified that error appears in the above-identified patent and that said Letters Patent are hereby corrected as shown below:

Item [*] in the left-hand column on the first page, line 2 of the Notice, "Feb. 11," should read --June 26,--.

Col. 2, line 54, "tilamentary" should read --filamentary--.
Col. 4, line 13, "the" should read --The--;
line 54, "aan" should read --an--.
Col. 5, line 3, "pullely" should read --pulley--;
line 49, "wrapper" should read --wrapped--;
line 50, "oribiting" should read --orbiting--.
Col. 6, line 13, "the" should read --The--.
Col. 8, line 49, "or" should read --an--.
Col. 9, line 49, "realy" should read --relay--.
Col. 10, line 6, "of" (second occurrence) should read --or--;
line 38, "realy" should read --relay--;
line 47, "porting" should be deleted.
Col. 11, line 39, "unti" should read --unit--.
Col. 12, line 22, "meter" should be deleted.
Col. 15, line 27, --device-- should be inserted after "delay".
Col. 16, line 34, "nozzle" should read --nozzles--.
Col. 17, line 11, "desired" should read --described--.
Col. 18, line 2, --at-- should be inserted after "signals".
Claim 3, line 2, "of" (second occurrence) should be deleted.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*